US010724710B2

(12) United States Patent
Jurik et al.

(10) Patent No.: US 10,724,710 B2
(45) Date of Patent: Jul. 28, 2020

(54) FRAMING SYSTEM FOR AN AUTOMATED LUMINAIRE

(71) Applicant: Robe Lighting s.r.o., Roznov pod Radhostem (CZ)

(72) Inventors: Pavel Jurik, Prostredni Becva (CZ); Josef Valchar, Prostredni Becva (CZ)

(73) Assignee: Robe Lighting s.r.o., Roznov pod Radhostem (CZ)

( * ) Notice: Subject to any disclaimer, the term of this patent is extended or adjusted under 35 U.S.C. 154(b) by 0 days.

(21) Appl. No.: 16/118,121

(22) Filed: Aug. 30, 2018

(65) Prior Publication Data

US 2018/0372305 A1 Dec. 27, 2018

Related U.S. Application Data

(63) Continuation-in-part of application No. 16/113,902, filed on Aug. 27, 2018, which is a (Continued)

(51) Int. Cl.
*F21V 14/06* (2006.01)
*F21V 5/02* (2006.01)
(Continued)

(52) U.S. Cl.
CPC ..... *F21V 14/06* (2013.01); *F21S 10/007* (2013.01); *F21V 5/008* (2013.01); *F21V 5/02* (2013.01); *F21W 2131/406* (2013.01)

(58) Field of Classification Search
CPC .... F21V 14/06–085; F21V 5/02; F21V 5/008; F21V 5/04; F21V 5/00;
(Continued)

(56) References Cited

U.S. PATENT DOCUMENTS 3,584,226 A 6/1971 Lerner
4,392,187 A 7/1983 Bornhorst
(Continued)

FOREIGN PATENT DOCUMENTS

CN 1711441 A 12/2005
CN 101430073 A 5/2009
(Continued)

OTHER PUBLICATIONS

"5.5 Prisms." Optics, by Eugene Hecht, 4th ed., Addison-Wesley, 2002, pp. 186-193. (Year: 2002).*
(Continued)

*Primary Examiner* — Bao Q Truong
(74) *Attorney, Agent, or Firm* — Conley Rose, P.C.; Grant Rodolph; Brooks W Taylor

(57) ABSTRACT

A framing system, automated luminaire, and method are provided. The framing system includes a first prism system and a second prism system. The first prism system includes a first barrel prism and positions the first barrel prism in a light beam or to remove the first barrel prism from the light beam. The first prism system may rotate the first barrel prism. The second prism system includes a second barrel prism and is configured to position the second barrel prism in the light beam that passes through the first prism system or to remove the second barrel prism from the light beam. The second prism system may rotate the second barrel prism.

20 Claims, 14 Drawing Sheets

Related U.S. Application Data continuation-in-part of application No. 15/516,399, filed as application No. PCT/US2015/053566 on Oct. 1, 2015.

(60) Provisional application No. 62/058,562, filed on Oct. 1, 2014, provisional application No. 62/553,565, filed on Sep. 1, 2017, provisional application No. 62/553,772, filed on Sep. 1, 2017.

(51) Int. Cl.

| | |
|---|---|
| ***F21S 10/00*** | (2006.01) |
| ***F21V 5/00*** | (2018.01) |
| *F21W 131/406* | (2006.01) |

(58) Field of Classification Search

CPC ..... F21V 13/00; F21V 14/00; F21S 10/007; F21W 2131/406; G02B 5/04

See application file for complete search history.

(56) References Cited

U.S. PATENT DOCUMENTS

| | | | | |
|---|---|---|---|---|
| 4,891,738 | A | 1/1990 | Richardson et al. | |
| 4,980,806 | A | 12/1990 | Taylor et al. | |
| 5,537,303 | A | 7/1996 | Stacy | |
| 5,934,794 | A * | 8/1999 | Hutton | F21S 10/007 362/283 |
| 6,502,964 | B1 * | 1/2003 | Simon | F21S 8/081 362/291 |
| 9,664,361 | B2 | 5/2017 | Hansen | |
| 2006/0187654 | A1 * | 8/2006 | Jungel-Schmid | F21S 8/02 362/147 |
| 2008/0055608 | A1 | 3/2008 | Bornhorst | |
| 2009/0268466 | A1 * | 10/2009 | Allegri | F21S 10/007 362/268 |
| 2010/0073927 | A1 * | 3/2010 | Lewin | F21V 5/04 362/240 |
| 2014/0233238 | A1 | 8/2014 | Quadri et al. | |
| 2016/0195237 | A1 * | 7/2016 | Quadri | F21V 5/007 362/232 |
| 2018/0187847 | A1 | 7/2018 | Jurik et al. | |
| 2019/0011820 | A1 * | 1/2019 | Nohechi | G03B 21/008 |

FOREIGN PATENT DOCUMENTS

| | | | |
|---|---|---|---|
| CN | 201416832 | Y | 3/2010 |
| CN | 202532389 | U | 11/2012 |
| CN | 203010295 | U | 6/2013 |
| CN | 103502865 | A | 1/2014 |
| CN | 203868942 | U | 10/2014 |
| CN | 107002973 | A | 8/2017 |
| DE | 102011113036 | A1 | 3/2012 |
| EP | 3056804 | A1 | 8/2016 |
| KR | 20140143065 | A | 12/2014 |
| WO | 9852386 | A1 | 11/1998 |
| WO | 2012138770 | A2 | 10/2012 |
| WO | 2016054418 | A1 | 4/2016 |

OTHER PUBLICATIONS

Jurik, Pavel, et al.; U.S. Appl. No. 16/113,902, filed Aug. 27, 2018; Title: Coordinated Effects System for an Automated Luminaire; 34 pages.

"Infinity iB-16R Manual"; https://www.highlite.nl/silver.download/Documents@extern@Manuals/41532_MANUAL_GB_V1.pdf; 2015; 44 pages.

"Infinity iB-2R Manual"; https://www.warmlight.at/media/pdf/41531_MANUAL_GB_V1.pdf; 2014; 36 pages.

Office Action dated May 11, 2018; U.S. Appl. No. 15/516,399, filed Apr. 1, 2017; 6 pages.

Office Action dated Oct. 25, 2018; U.S. Appl. No. 15/516,399, filed Apr. 1, 2017; 17 pages.

Office Action dated Nov. 19, 2018; U.S. Appl. No. 16/113,902, filed Aug. 27, 2018; 10 pages.

PCT International Search Report; Application No. PCT/US2015/053566; dated Mar. 7, 2016; 5 pages.

PCT Written Opinion of the International Searching Authority; Application No. PCT/US2015/053566; dated Mar. 7, 2016; 5 pages.

Chinese Office Action; Application No. 201580065444.6; dated Oct. 8, 2018; 12 pages.

European Examination Report; Application No. 15820914.8; dated Jul. 25, 2018; 6 pages.

European Extended Search Report; Application No. 18192006.7; dated Nov. 26, 2018; 6 pages.

European Partial Search Report; Application No. 18191994.5; dated Nov. 26, 2018; 11 pages.

Final Office Action dated Apr. 3, 2019; U.S. Appl. No. 15/516,399, filed Apr. 1, 2017; 24 pages.

Final Office Action dated Apr. 3, 2019; U.S. Appl. No. 16/113,902, filed Aug. 27, 2018; 24 pages.

European Intention to Grant; Application No. 15820914.8; Apr. 11, 2019; 10 pages.

European Extended Search Report; Application No. 18191994.5; Feb. 5, 2019; 10 pages.

Advisory Action dated Jun. 4, 2019; U.S. Appl. No. 15/516,399, filed Apr. 1, 2017; 3 pages.

Office Action dated Jul. 25, 2019; U.S. Appl. No. 15/516,399, filed Apr. 1, 2017; 17 pages.

Advisory Action dated Jun. 4, 2019; U.S. Appl. No. 16/113,902, filed Aug. 27, 2018; 3 pages.

Office Action dated Jul. 24, 2019; U.S. Appl. No. 16/113,902, filed Aug. 27, 2018; 22 pages.

Office Action dated Jul. 26, 2019; U.S. Appl. No. 16/113,902, filed Aug. 27, 2018; 24 pages.

Chinese Office Action; Application No. 201580065444.6; dated Jun. 20, 2019; 13 pages.

European Examination Report; Application No. 18191994.5; dated Jun. 24, 2019; 5 pages.

Chinese Office Action; Application No. 201580065444.6; dated Oct. 9, 2019; 11 pages.

Chinese Office Action; Application No. 201811023325.6; dated Nov. 21, 2019; 21 pages.

Final Office Action dated Jan. 29, 2020; U.S. Appl. No. 15/516,399, filed Apr. 1, 2017; 19 pages.

European Intention to Grant; Application No. 18191994.5; dated Jan. 3, 2020; 11 pages.

Advisory Action dated Jun. 8, 2020; U.S. Appl. No. 15/516,399, filed Apr. 1, 2017; 5 pages.

Notice of Allowance dated Apr. 15, 2020; U.S. Appl. No. 16/113,902, filed Aug. 27, 2018; 21 pages.

Chinese Notification of Allowance; Application No. 201580065444.6; dated Mar. 18, 2020; 5 pages.

Chinese Office Action; Application No. 201811023325.6; dated Apr. 27, 2020; 22 pages.

* cited by examiner 400
32
34
36
38
40
42
44
46
48
50
52
54
56
58
60
62
64
66
68
70
72
74
76
78
80
82
84
86
88
90
92
94
96
98
100
102
104
106
108
110

FRAMING SYSTEM FOR AN AUTOMATED LUMINAIRE

CROSS-REFERENCE TO RELATED APPLICATIONS

This application is a continuation in part of U.S. patent application Ser. No. 16/113,902 filed Aug. 27, 2018 by Pavel Jurik, et al. entitled, "Coordinated Effects System for an Automated Luminaire", which is a continuation in part of Ser. No. 15/516,399 filed Apr. 1, 2017 by Pavel Jurik, et al. entitled, "Improved Coordinated Effects System for an Automated Luminaire", which is a U.S. National Stage of International Patent Application No. PCT/US2015/053566 filed Oct. 1, 2015 by Pavel Jurik, et al. entitled, "Improved Coordinated Effects System for an Automated Luminaire", which claims priority to U.S. Provisional Application No. 62/058,562 filed Oct. 1, 2014 by Pavel Jurik, et al. entitled, "System and Method for Controlling the Movement of LEDs in a Luminaire". U.S. patent application Ser. No. 16/113,902 also claims priority to U.S. Provisional Application No. 62/553,565 filed Sep. 1, 2017 by Pavel Jurik, et al. entitled, "Coordinated Effects System for an Automated Luminaire". The present application also claims priority to U.S. Provisional Application No. 62/553,772 filed Sep. 1, 2017 by Pavel Jurik, et al. entitled, "Coordinated Effects System for an Automated Luminaire", all of which are incorporated by reference herein as if reproduced in their entirety.

TECHNICAL FIELD OF THE DISCLOSURE

The disclosure generally relates to an automated luminaire, and more specifically to a framing system for an automated luminaire.

BACKGROUND

Luminaires with automated and remotely controllable functionality are well known in the entertainment and architectural lighting markets. Such products are commonly used in theatres, television studios, concerts, theme parks, night clubs, and other venues. A typical product will commonly provide control over the pan and tilt functions of the luminaire allowing the operator to control the direction the luminaire is pointing and thus the position of the light beam on the stage or in the studio. Typically, this position control is done via control of the luminaire's position in two orthogonal rotational axes usually referred to as pan and tilt. Many products provide control over other parameters such as the intensity, color, focus, beam size, beam shape, and beam pattern. FIG. 1 illustrates a typical multiparameter automated luminaire system 10. These systems typically include a plurality of multiparameter automated luminaires 12 which typically each contain on-board a light source (not shown), light modulation devices, electric motors coupled to mechanical drives systems, and control electronics (not shown). In addition to being connected to mains power either directly or through a power distribution system (not shown), each luminaire 12 is connected is series or in parallel via data link 14 to one or more control desks 15. An operator typically controls the automated luminaire system 10 through the control desk 15.

An optical effect that is commonly used in prior art automated luminaires is often referred to as a prism. This is typically a glass or plastic device placed at a point in the optical train such that it converts a single image produced by the beam color, size, shape, and pattern optical systems into multiple beams for display. For example, a linear prism may convert a single beam into a linear array of identical beams. A diagrammatic example of the effects produced by a prior art prism optical system is shown in FIGS. 2 and 3. In FIG. 2, a single image 20 produced by the beam color, size, shape, and pattern optical systems passes through a prism 21*a*, resulting in multiple copies of the image 20 as output images 22*a*. The prism 21*a* may be rotated as indicated by the arc 23, causing a corresponding rotation in the array of output images as indicated by the arc 24. FIG. 3 shows the same optical system and prism 21*a*, but with the prism 21*a* rotated to a new position, resulting in a corresponding rotation of the output images 22*b*. Image 20 is here shown for clarity as a simple circular image; however, the image 20 may be any image, complex or simple, as produced by the automated luminaire, in particular it may have a shape defined by patterns or gobos in the optical train.

In further prior art systems the prism may be different shapes and may be capable of being inserted or removed from the light beam automatically. It may further be possible to select different prisms producing different effects for insertion in the beam. However, the prior art systems are only capable of introducing a single prism at one time.

It would be advantageous to provide a system for an automated luminaire that was capable of introducing a plurality of prisms into the optical effect chain simultaneously such that the effects concatenate. It would further be advantageous to be able to selectively and cooperatively coordinate the insertion, position, and rotation of the plurality of prisms to produce new dynamic lighting effects.

SUMMARY

In a first embodiment, a framing system includes a first prism system and a second prism system. The first prism system includes a first barrel prism and is configured to position the first barrel prism in a light beam that passes through the first prism system or to remove the first barrel prism from the light beam. The first prism system is further configured to rotate the first barrel prism. The second prism system includes a second barrel prism and is configured to position the second barrel prism in the light beam that passes through the first prism system or to remove the second barrel prism from the light beam. The second prism system is further configured to rotate the second barrel prism.

In a second embodiment, an automated luminaire includes a light source configured to emit a light beam and an optical device coupled to the light source and configured to produce a first image in the light beam. The automated luminaire further includes a first prism system, a second prism system, and a control system. The first prism system includes a first barrel prism and is configured to position the first barrel prism in a light beam that passes through the first prism system or to remove the first barrel prism from the light beam. The first prism system is further configured to rotate the first barrel prism. The second prism system includes a second barrel prism and is configured to position the second barrel prism in the light beam that passes through the first prism system or to remove the second barrel prism from the light beam. The second prism system is further configured to rotate the second barrel prism. The control system is configured to control the optical device, the first prism system, and the second prism system.

In a third embodiment, a method for shaping a light beam projected by an automated luminaire includes forming a circular light beam and modifying the circular light beam with a selected barrel gobo to form a rounded rectangular beam having a desired aspect ratio. The method further includes rotating the barrel prism to obtain a desired orientation of the rounded rectangular beam and projecting the rotated rounded rectangular beam from an automated luminaire onto a target in a performance space.

BRIEF DESCRIPTION OF THE DRAWINGS

For a more complete understanding of the present disclosure and the advantages thereof, reference is now made to the following description taken in conjunction with the accompanying drawings in which like reference numerals indicate like features and wherein.

DETAILED DESCRIPTION

Preferred embodiments are illustrated in the figures, like numerals being used to refer to like and corresponding parts of the various drawings.

Disclosed herein are a coordinated effects system and an automated luminaire. The automated luminaire includes a light source, an optical device, a first prism system, a second prism system, and a control system. The light source is configured to emit a light beam. The optical device is configured to produce a first image in the light beam. The first and second prism systems include corresponding first and second pluralities of prisms and are configured to position selected ones of their respective prisms in the light beam or to remove all of their prisms from the light beam. The first prism system is configured to rotate the selected one of its prisms to produce a modified image from the image. The second prism system is configured to rotate the selected one of its prisms to produce an output image from the modified image. The control system is configured to control the first and second prism systems.

Figure 4:
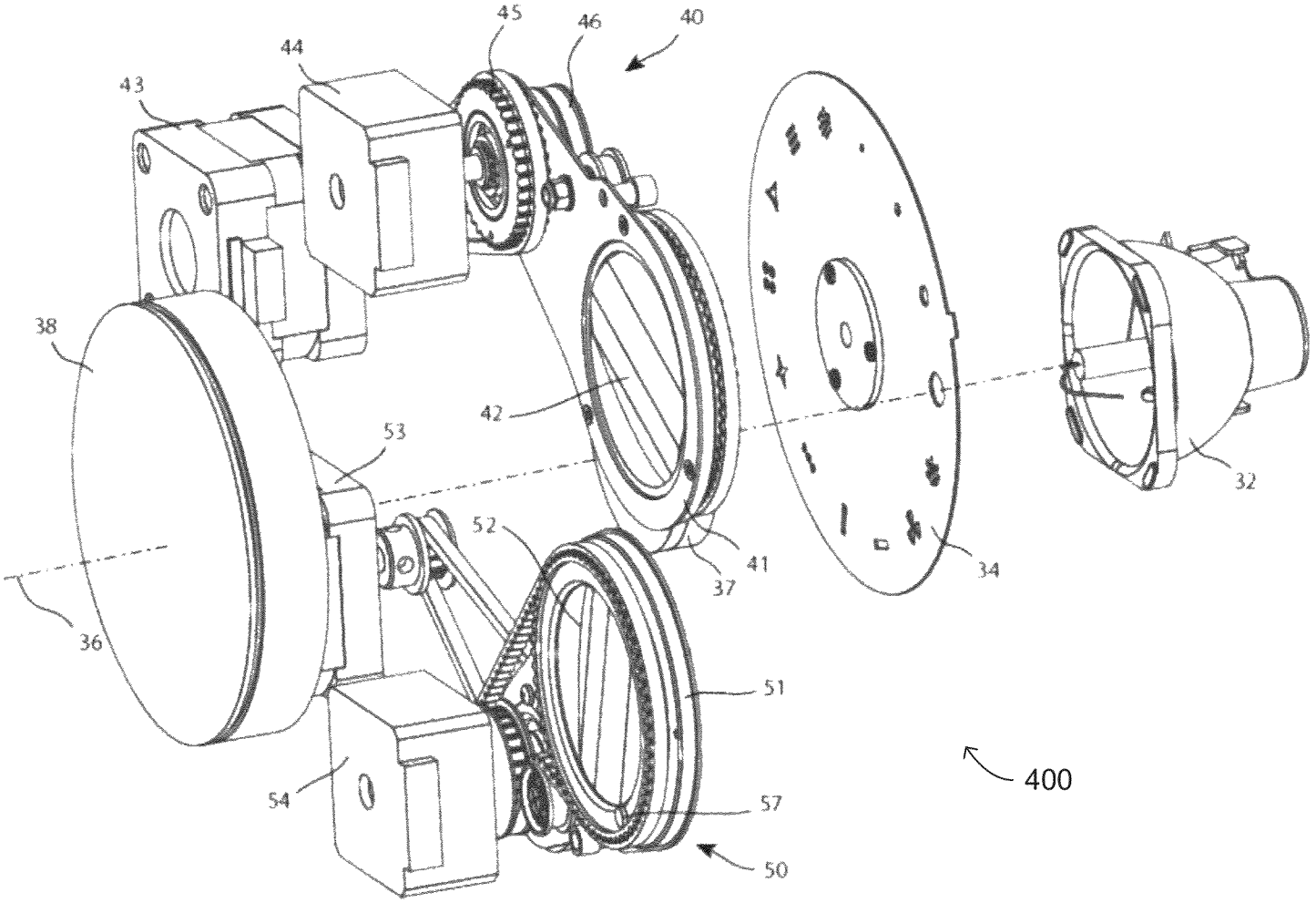
FIG. 4 illustrates an optical system with a first coordinated effects system according to the disclosure in a first configuration.

FIG. 4 illustrates an optical system with a first coordinated effects system 400 according to the disclosure in a first configuration. A light source 32 produces a light beam whose optical axis is shown by dotted line 36. The light beam may pass through gobo wheel 34 and optical lenses 37 and 38 before being emitted from the luminaire. The optical system is shown here much simplified for clarity and, in practice, an automated luminaire may include further optical devices, including but not restricted to, a color wheel, a color mixing mechanism, a rotating gobo, an effects wheel, an iris, a framing shutters mechanism, and other optical devices as known in the art.

The first coordinated effects system 400 includes a first prism system 40. The first prism system 40 comprises a first prism 42 rotatably mounted to a first prism arm 41. A motor 44 is configured to rotate the first prism 42 within first prism arm 41 via a belt 46. Motor 43 is configured to rotate the first prism arm 41 via a gear 45 to insert or remove the first prism 42 into the light beam. The motors 43 and 44 may be operated in a coordinated manner such that the first prism 42 is inserted or removed from the light beam and rotated within the light beam as desired by an operator. The motors 43 and 44 may be of a type selected from, but not restricted to, stepper motor, servo-motor, actuator, solenoid, and other motor types as known in the art. In the configuration shown in FIG. 4, the first prism 42 is positioned outside of the light beam and has no effect on the light beam emitted from the luminaire.

The first coordinated effects system 400 further includes a second prism system 50. The second prism system 50 comprises a second prism 52 rotatably mounted to a second prism arm 51. The motor 54 is configured to rotate the second prism 52 within the second prism arm 51. A motor 53 is configured to rotate the second prism arm 51 to insert or remove the second prism 52 into the light beam. The motors 53 and 54 may be operated in a coordinated manner such that second prism 52 is inserted or removed from the light beam and rotated within the light beam as desired by the operator. The motors 53 and 54 may be of a type selected from, but not restricted to, stepper motor, servo-motor, actuator, solenoid, and other motor types as known in the art. In the configuration shown in FIG. 4, the second prism 52 is positioned outside of the light beam and has no effect on the light beam emitted from the luminaire.

Either or both of the first prism system 40 and the second prism system 50 may include sensors such that the control system of the automated luminaire is aware of, and able to control, the orientation and/or rotation of the first prism 42 and the second prism 52. For example, as illustrated in FIG. 4, the second prism 52 is fitted with a magnet 57 in its periphery that rotates with the second prism 52. A corresponding sensor or sensors (not shown) such as a Hall effect sensor in second prism system 50 may detect the position of magnet 57, and thus sense the rotational position of second prism 52 at the moment the magnet 57 is detected. Similarly, first prism system 40 may be fitted with a magnet and sensor or sensors such that the rotational position of first prism 42 is known and communicated to the control system of the automated luminaire 100. The sensor systems are not restricted to a magnet and Hall effect sensor, and any sensing system may be utilized in other coordinated effects system according to the disclosure, including, but not restricted to, magnetic sensors, optical sensors, and switch sensors.

Figure 1:
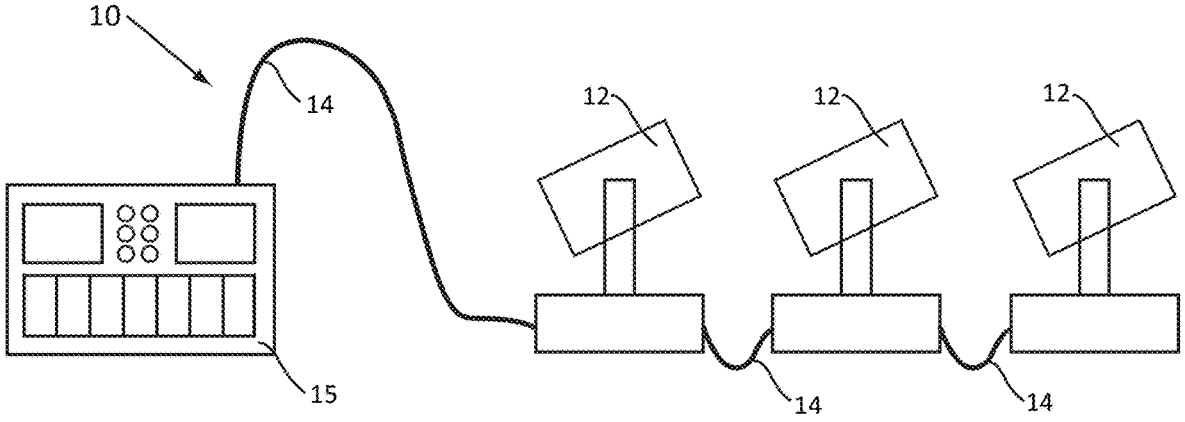
FIG. 1 PRIOR ART
FIG. 1 illustrates a typical prior art automated lighting system.
Figure 2:
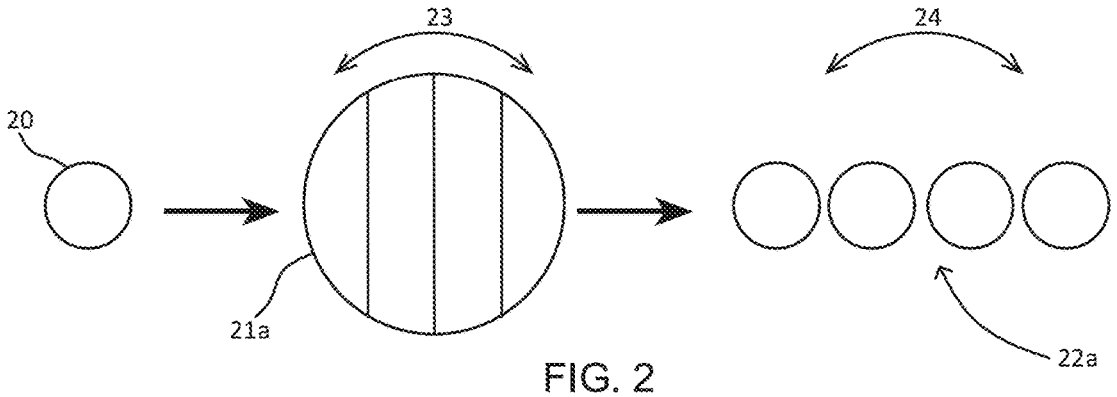
FIG. 2 PRIOR ART
FIG. 2 illustrates a prior art prism effects system.
Figure 3:
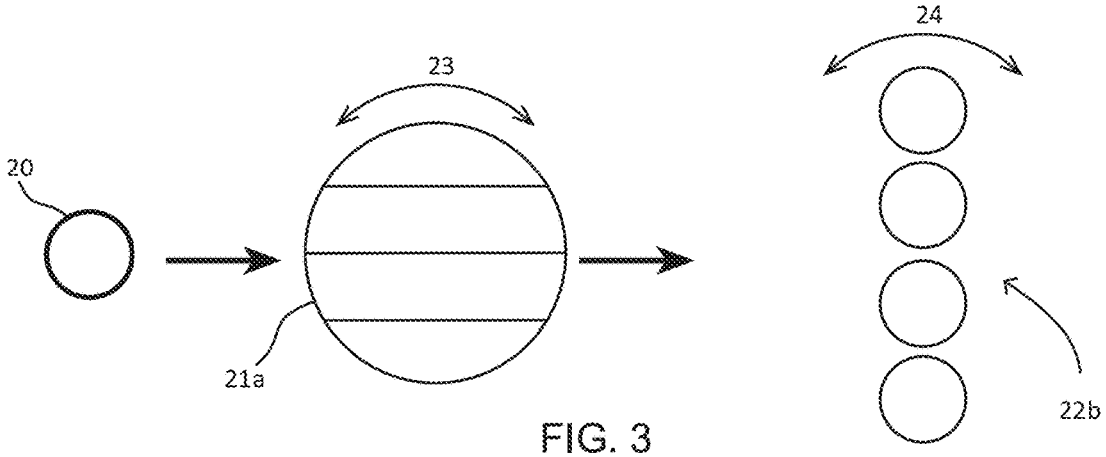
FIG. 3 PRIOR ART
FIG. 3 illustrates a prior art prism effects system.
Figure 5:
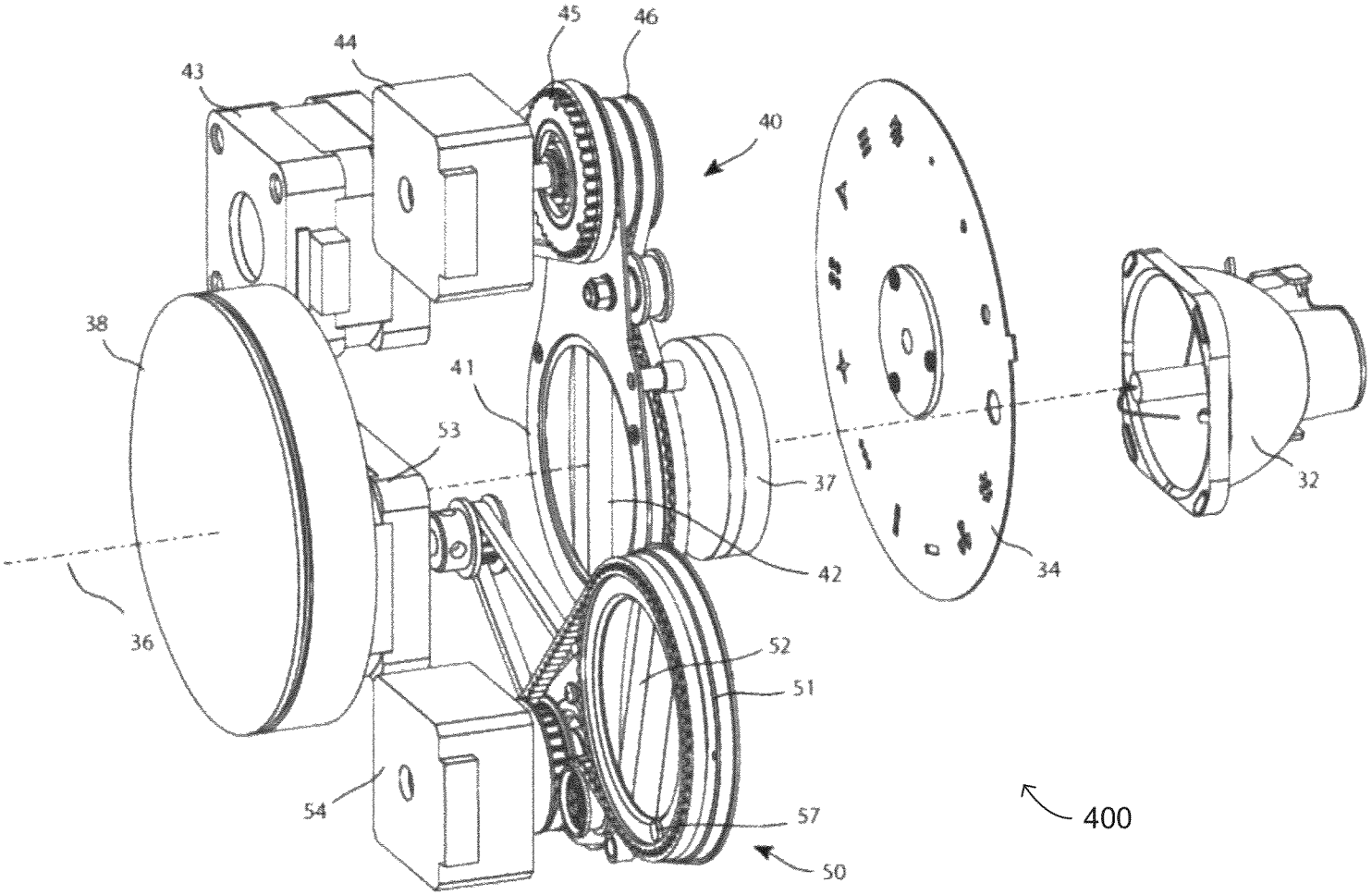
FIG. 5 illustrates the first coordinated effects system of FIG. 4 in a second configuration.

FIG. 5 illustrates the first coordinated effects system 400 in a second configuration. In FIG. 5, the motor 43 has been operated from the configuration shown in FIG. 4 to rotate the first prism arm 41, and thus the first prism 42 has been inserted into the light beam. The second prism 52 remains outside the light beam. In this configuration, the first prism 42 alone will produce an effect in the light beam. The first prism 42 may be rotated while in the light beam by the motor 44, producing effects similar to those illustrated in FIGS. 2 and 3.

Figure 6:
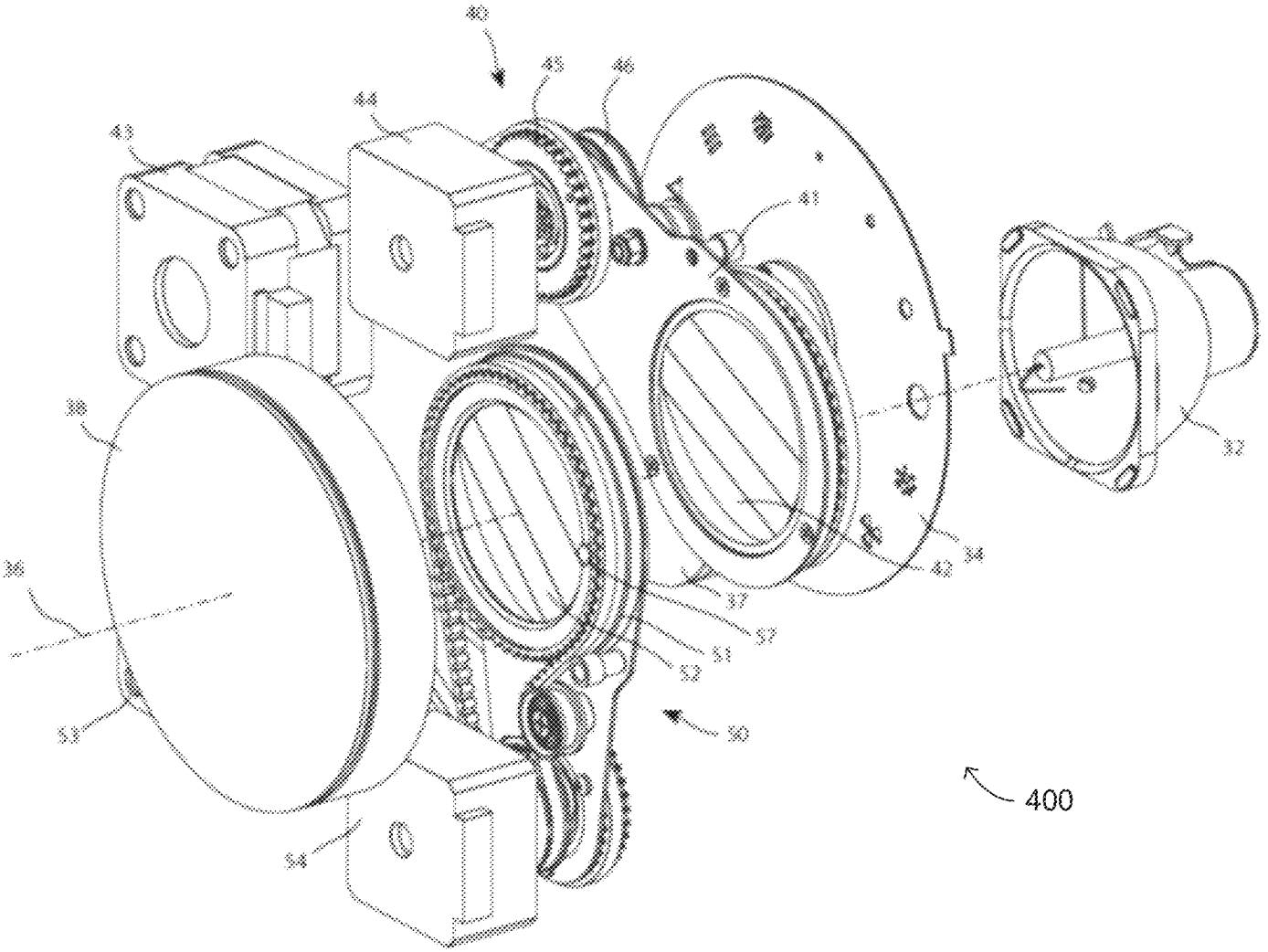
FIG. 6 illustrates the first coordinated effects system of FIG. 4 in a third configuration.

FIG. 6 illustrates the first coordinated effects system 400 in a third configuration. In FIG. 6, the motor 53 has been operated from the configuration shown in FIG. 4 to rotate the second prism arm 51, and thus the second prism 52 has been inserted into the light beam. The first prism 42 remains outside light beam. In this configuration, the second prism 52 alone will produce an effect in the light beam. The second prism 52 may be rotated within the light beam by the motor 54, producing effects similar to those illustrated in FIGS. 2 and 3.

Figure 7:
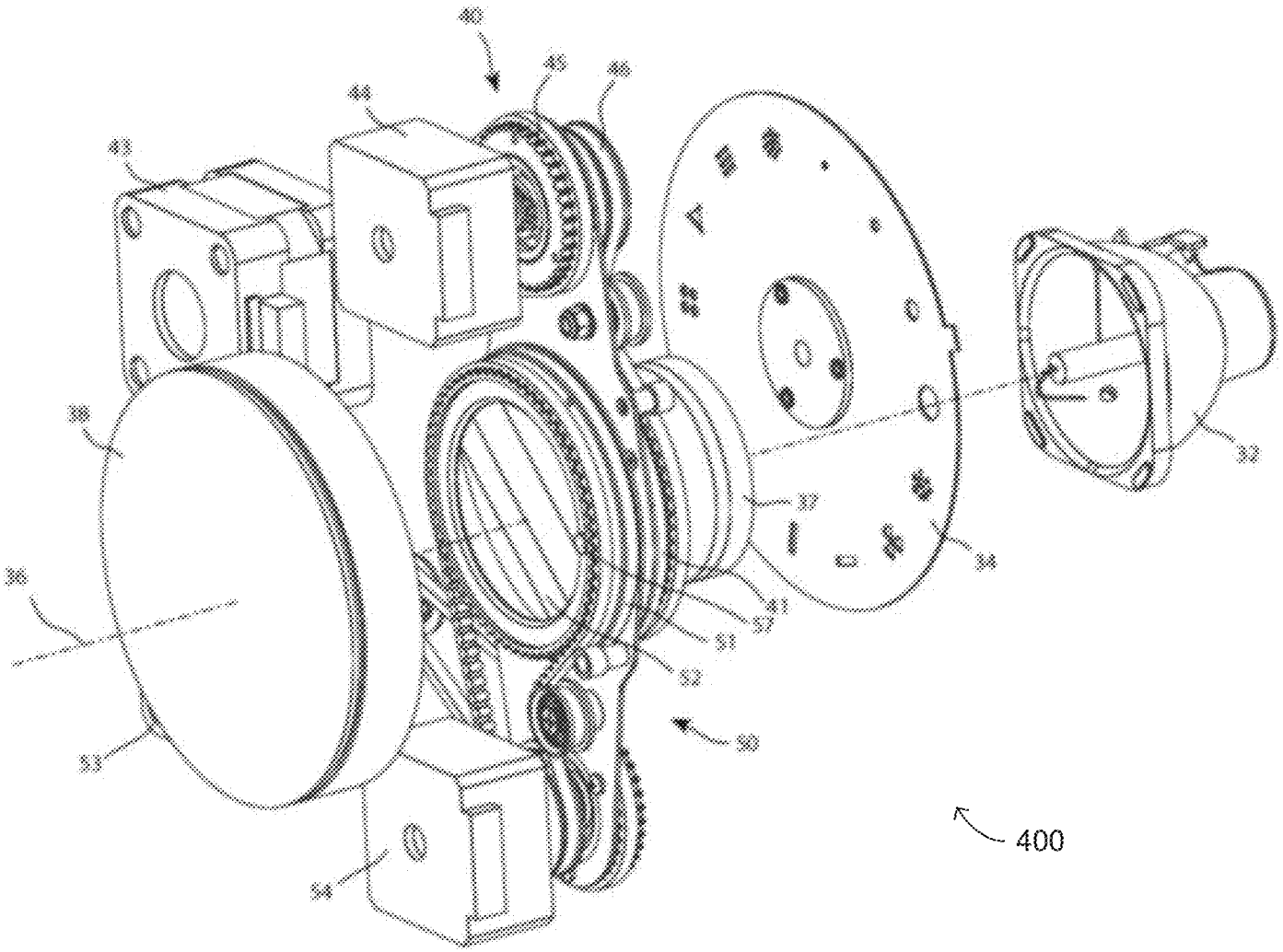
FIG. 7 illustrates the first coordinated effects system of FIG. 4 in a fourth configuration.

FIG. 7 illustrates the first coordinated effects system 400 in a fourth configuration. In FIG. 7, the motor 43 has been operated from the configuration shown in FIG. 4 to rotate the first prism arm 41, and thus the first prism 42 has been inserted across the light beam. Further, motor 53 has also been operated to rotate the second prism arm 51, and thus the second prism 52 has been inserted into the light beam. In this position both the first prism 42 and the second prism 52 will produce effects in the light beam. The first prism 42 and the second prism 52 may be rotated while in the light beam by the motors 44 and 54, respectively. The second prism 52 receives the light beam after it has passed through, and been affected by, the first prism 42. Thus, the effect produced by the first prism 42 is then further modified by the second prism 52.

Figure 8:
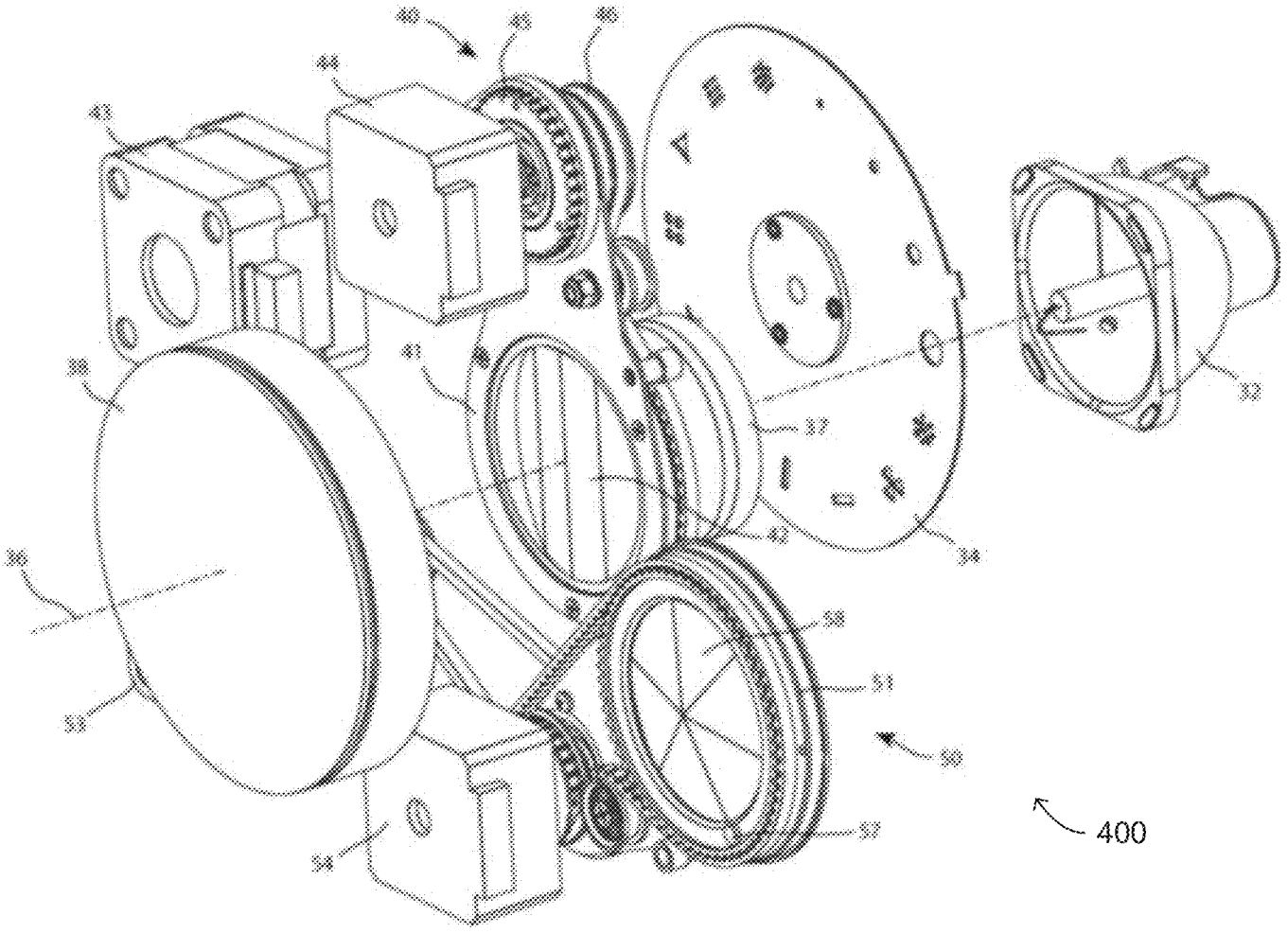
FIG. 8 illustrates the first coordinated effects system of FIG. 4 in the second configuration with an alternative second prism.

FIG. 8 illustrates the first coordinated effects system 400 in the second configuration with an alternative second prism 58. Similarly, first prism 42 may be replaced with alternative prism designs.

Figure 9:
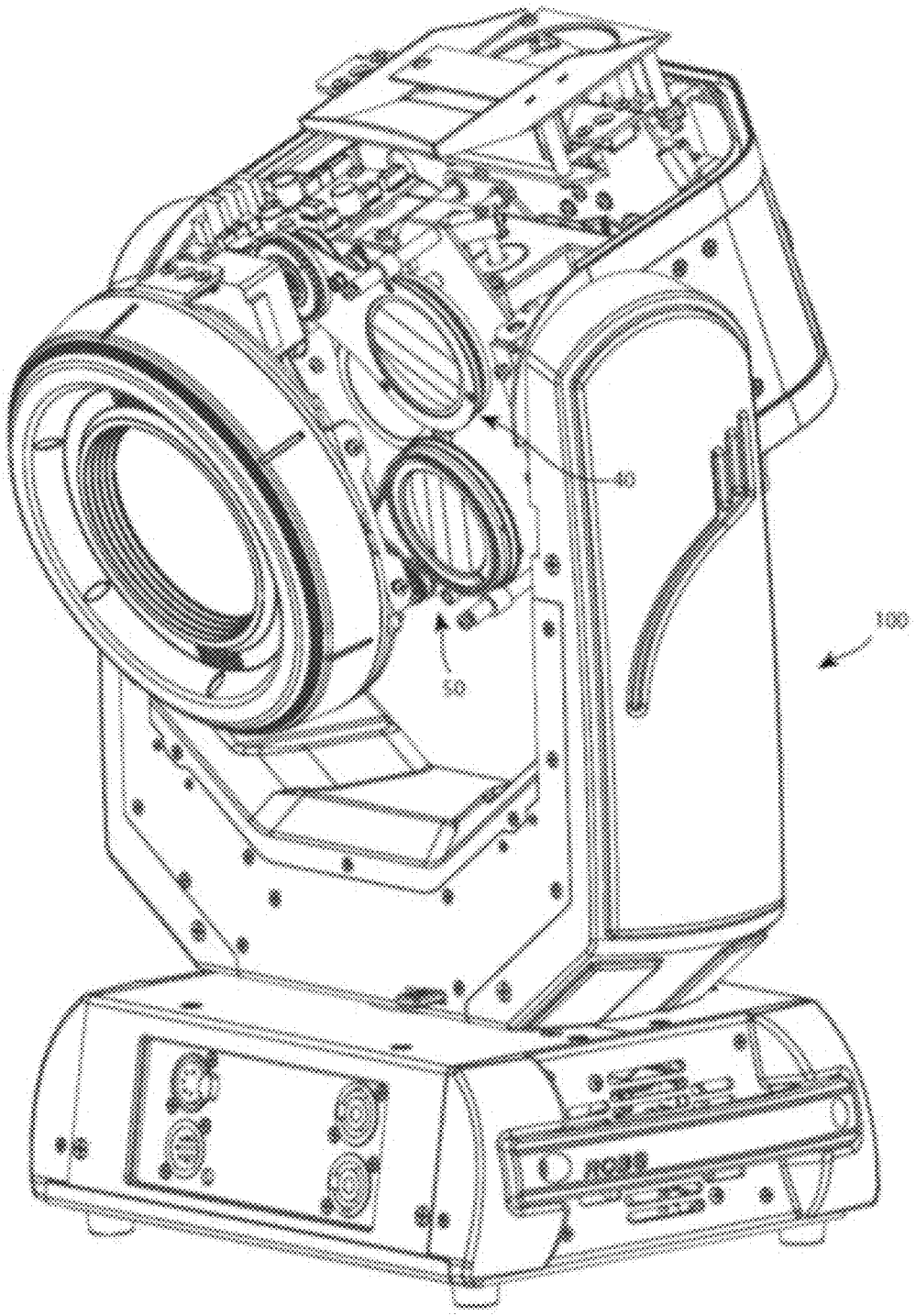
FIG. 9 illustrates an automated luminaire according to the disclosure, fitted with the first coordinated effects system of FIG. 4.

FIG. 9 illustrates an automated luminaire 100 according to the disclosure, fitted with the first coordinated effects system 400.

Figure 10:
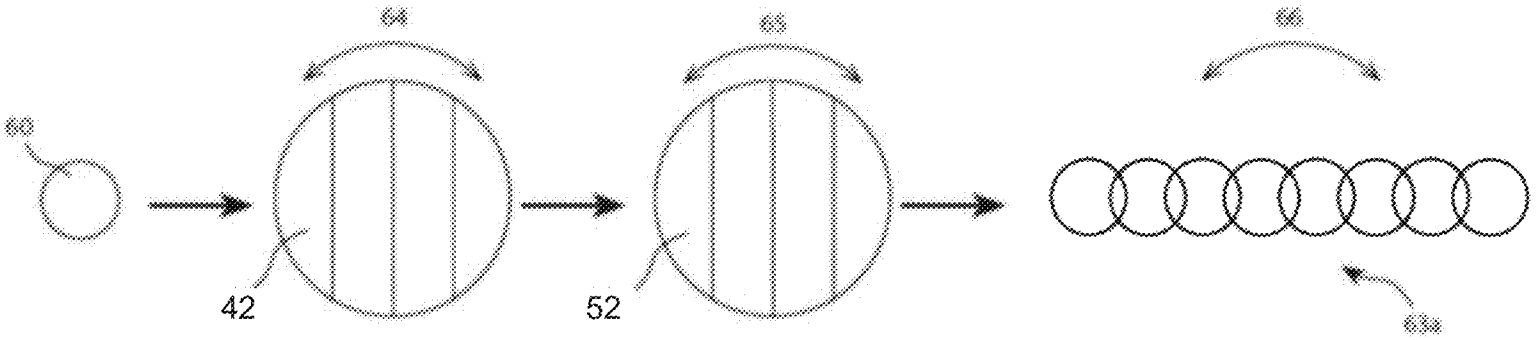
FIG. 10 illustrates an effect of the first coordinated effects system of FIG. 4 in the fourth configuration with prisms of the first coordinated effects system in a first position relative to each other.
Figure 11:
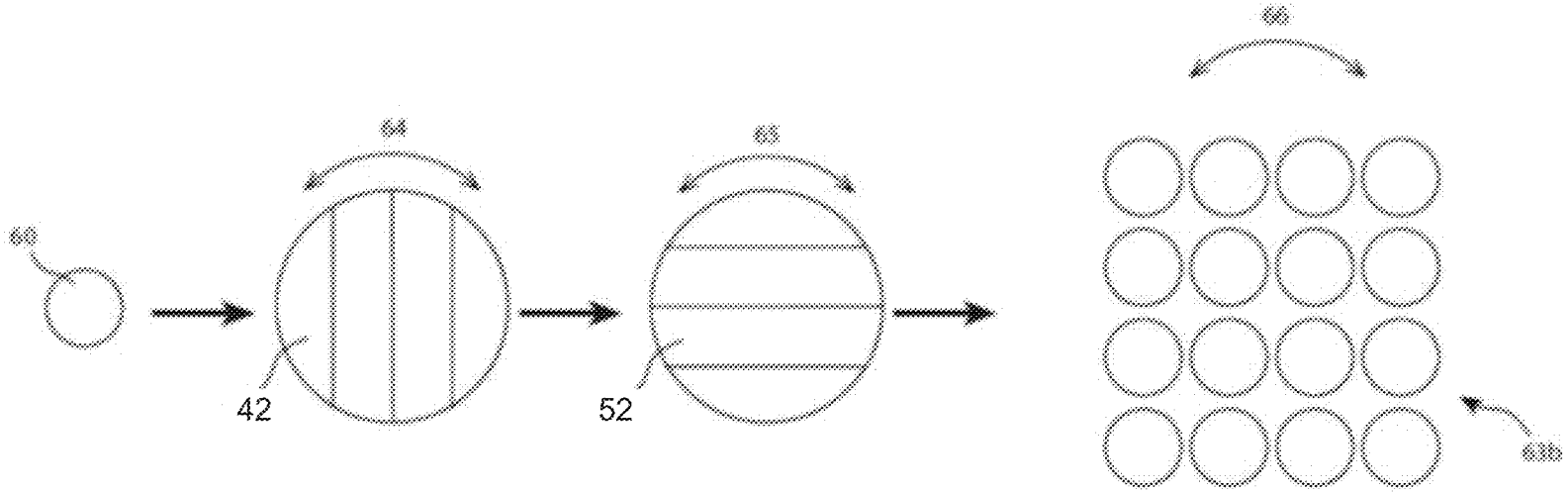
FIG. 11 illustrates an effect of the first coordinated effects system of FIG. 4 in the fourth configuration with prisms of the first coordinated effects system in a second position relative to each other.

FIGS. 10 and 11 illustrate effects of the first coordinated effects system 400 in the fourth configuration. FIG. 10 illustrates an effect of the first coordinated effects system 400 with the first prism 42 and the second prism 52 in a first position relative to each other. A single image 60 produced by beam color, size, shape, and pattern optical systems of the automated luminaire 100 passes through first prism 42 and second prism 52, resulting in multiple copies of the image 60 as output image 63*a*. Image 60 is here shown for clarity as a simple circular image; however, image 60 may be any complex image as produced by the automated luminaire, in particular it may have a shape defined by the patterns or gobos in the optical train.

Because the first prism 42 and the second prism 52 are both linear prisms and are aligned in a parallel manner, the resulting output image 63*a* is also linearly aligned. However, both first prism 42 and second prism 52 may be rotated independently, as indicated by arcs 64 and 65, respectively, causing a change in pattern and rotation (as indicated by arc 66) in the output image 63*a*. For example, if the first prism 42 and second prism 52 are rotated in the same direction at the same speed, maintaining their rotational alignment, the output image 63*a* will maintain its shape and rotate.

FIG. 11 illustrates an effect of the first coordinated effects system 400 in the fourth configuration with the first prism 42 and the second prism 52 of the first coordinated effects system 400 in a second position relative to each other. The first prism 42 remains in the same position as in FIG. 10; however, the second prism 52 has been rotated 90° to a new position orthogonal to its position in FIG. 10. In this configuration, the linear effect of the first prism 42 still forms a single linear array of the image 60; however, the second prism 52 now acts on that first linear array in an orthogonal direction, resulting in an output image 63*b* that is a matrix array of the linear array produced by the first prism 42. As described with reference to FIG. 10, if the first prism 42 and second prism 52 are rotated in the same direction at the same speed, maintaining their rotational alignment, the output image 63*b* will rotate while maintaining its shape.

Intermediate angles between the first prism 42 and the second prism 52 to the angles shown in FIGS. 10 and 11 will produce output images intermediate between output images 63*a* and 63*b* that change shape and configuration smoothly as the angle between the first prism 42 and the second prism 52 changes. If the angle changes slowly, the variation in the output images also changes slowly. Similarly, if the angle changes quickly, the variation in the output images also changes quickly.

The first prism 42 and the second prism 52 may be simultaneously rotated in a coordinated manner, such that the angle between them remains constant. For example, both prisms may be rotated in the same direction at the same speeds, thus maintaining the difference in angle between them. This results in an output image that remains static and rotates at the same rate as the prisms. In some embodiments, such rotation may be performed without information received from sensors fitted to the first prism 42 and the second prism 52. In other embodiments, the sensors fitted to the first prism 42 and the second prism 52 enable the control system of the automated luminaire 100 to maintain improved coordination in the rotation and positioning of the prisms. The first prism 42 and the second prism 52 may be simultaneously rotated in a coordinated manner at differing speeds and/or in differing directions, resulting in output images that change and/or rotate. Either or both of the first prism 42 and the second prism 52 may be rotated while the other is held static (i.e., at a rotational speed of zero). Speeds and rotation directions and positions may be accurately controlled through the sensors to produce accurate and repeatable coordinated effects in the output images.

Figure 12:
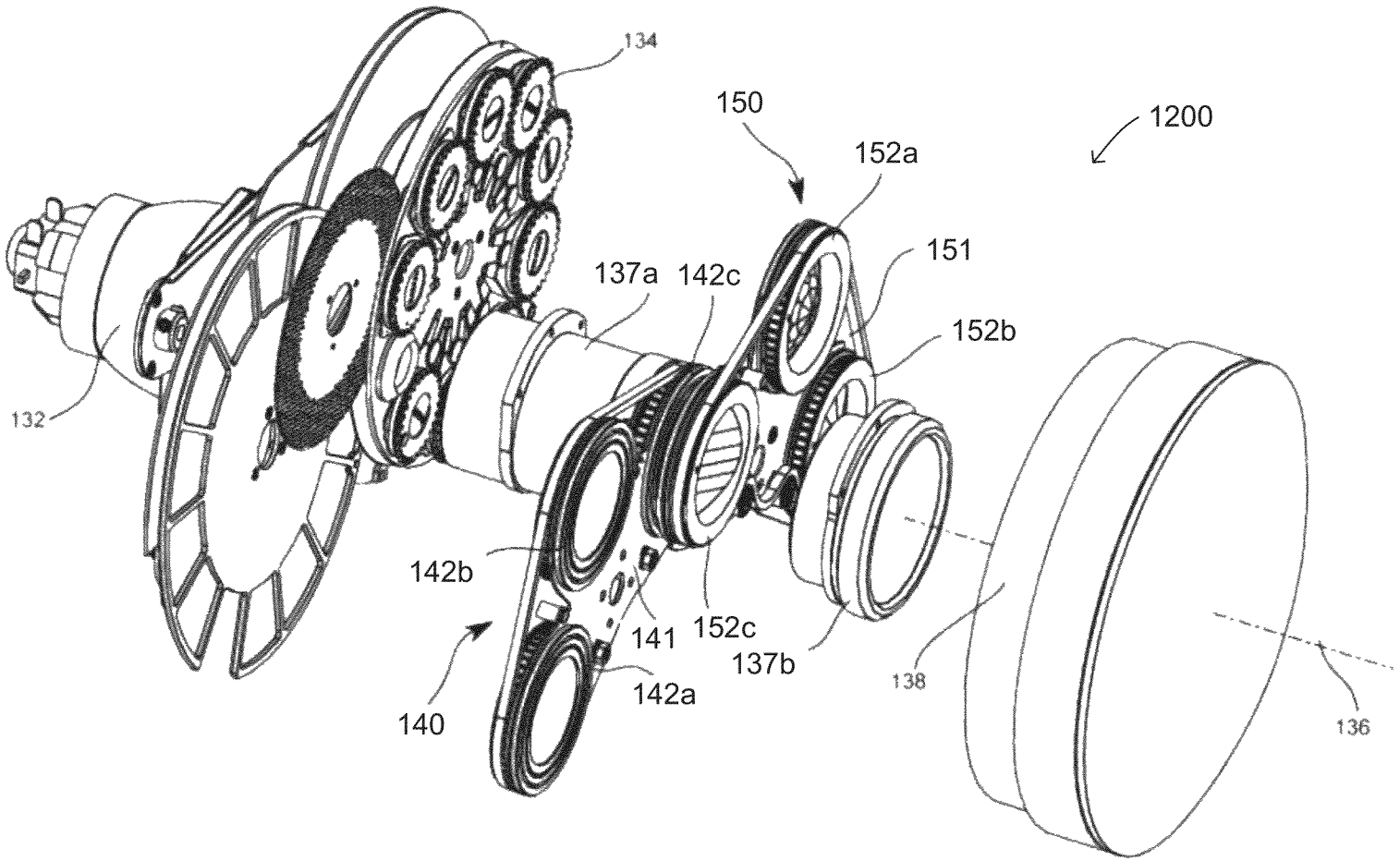
FIG. 12 illustrates an optical system including a second coordinated effects system according to the disclosure in a first configuration.

FIG. 12 illustrates an optical system including a second coordinated effects system 1200 according to the disclosure in a first configuration. The second coordinated effects system 1200 may be used in place of the first coordinated effects system 400 in an automated luminaire according to the disclosure, or elements of the second coordinated effects system 1200 may be added to the first coordinated effects system 400 in the automated luminaire 100. A light source 132 produces a light beam whose optical axis is shown by dotted line 136. The light beam passes through a gobo wheel 134 and optical lenses 137*a*, 137*b*, and 138 before being emitted from the luminaire. The optical system is shown here much simplified for clarity and, in practice, the automated luminaire may include further optical devices including but not restricted to a color wheel, a color mixing mechanism, a rotating gobo, an effects wheel, an iris, a framing shutters mechanism, and other optical devices as known in the art.

The second coordinated effects system 1200 includes a first prism system 140. The first prism system 140 comprises a prism 142*a*, a prism 142*b*, and a prism 142*c*, all rotatably mounted to a first prism support (or arm) 141. A motor (not shown) is configured to rotate the prisms 142*a*, 142*b*, and 142*c* within the first prism support 141. A second motor (not shown) is configured to rotate the first prism support 141 to insert one of the prisms 142*a*, 142*b*, or 142*c* into the light beam, or to remove all three prisms from the light beam. The motors may be operated in a coordinated manner such that one of the prisms 142*a*, 142*b*, and 142*c* is inserted or removed from the light beam and rotated within the light beam, as desired by the operator. The motors (or actuators) may be of a type selected from, but not restricted to, stepper motor, servo-motor, actuator, solenoid, and other motor types as known in the art. In the configuration shown in FIG. 12, the prisms 142*a* and 142*b* are positioned outside of light beam and will have no effect on the exiting light beam, while the prism 142*c* is positioned in the light beam.

The second coordinated effects system 1200 further includes a second prism system 150. The second prism system 150 comprises a prism 152*a*, a prism 152*b*, and a prism 152*c* rotatably mounted to a second prism support (or arm) 151. A third motor (not shown) is configured to rotate the prisms 152*a*, 152*b*, and 152*c* within the second prism support 151. A fourth motor (not shown) is configured to rotate the second prism support 151 to insert one of the prisms 152*a*, 152*b*, or 152*c* into the light beam, or to remove all three prisms from the light beam. The motors may be operated in a coordinated manner such that one of the prisms 152*a*, 152*b*, and 152*c* is inserted or removed from the light beam and rotated within the light beam, as desired by the operator. The motors (or actuators) may be of a type selected from, but not restricted to, stepper motor, servo-motor, actuator, solenoid, and other motor types as known in the art. In the configuration shown in FIG. 12, the prisms 152*a* and 152*b* are positioned outside of light beam and will have no effect on the exiting light beam, while the prism 152*c* is positioned into the light beam. In these positions the prism 142*c* and the prism 152*c* are both positioned in the light beam and will interact to produce results similar to those shown in FIGS. 2, 3, 10, and 11.

In the first configuration of the second coordinated effects system 1200, the prism 142*c* of the first prism system 140 is positioned in the light beam produced by the light source 132. The prism 152*c* of the second prism system 150 is positioned in the light beam as modified by the first prism system 140. As described with reference to FIGS. 10 and 11, the prism 142*c* produces a first effect in the light beam (or modified image) and the prism 152*c* produces a second effect in the light beam as modified by the prism 142*c*, resulting in an output image.

The ability to position selected prisms from one or both of the first prism system 140 and the second prism system 150 in the light beam, and to selectively rotate either or both of the selected prisms enables an operator of an automated luminaire according to the disclosure to concatenate the effects of the selected prisms and to selectively and cooperatively coordinate the insertion and rotation of the selected prisms to produce new dynamic lighting effects.

When the second coordinated effects system 1200 is in a configuration similar to that shown in FIG. 6 (i.e., with the prisms of the first prism system 140 removed from the light beam and a prism from the second prism system 150 positioned in the light beam), the prism from the second prism system 150 is still characterized for purposes of this disclosure as receiving the light beam as modified by the first prism system 140.

Either or both of the first prism system 140 and the second prism system 150 may further include sensors such that the control system of the automated luminaire is able to detect and control the orientation and/or rotation of the prisms 142*a*, 142*b*, or 142*c* and the prisms 152*a*, 152*b*, or 152*c*. For example, each of the prisms may be fitted with magnets in their respective peripheries that rotate with them. A corresponding sensor or sensors (not shown) such as a Hall effect sensor in the first prism system 140 and the second prism system 150 may detect the position of the magnets, and thus deduce the rotational position of the prisms.

The sensors are not restricted to a magnet and Hall effect sensor, and any sensing system may be utilized in other embodiments of the disclosure, including, but not restricted to, magnetic sensors, optical sensors, and switch sensors. In some embodiments, a single sensor may be used for each of the first prism system 140 and the second prism system 150, mounted in positions that permit them to sense whichever of the prisms of the first prism system 140 and/or the second prism system 150 are positioned in the light beam.

While the prism systems 140 and 150 are described as each comprising a single motor that rotates all three prisms in its prism system, it will be understood that in other embodiments a prism system according to the disclosure may include one or more actuators to individually rotate one or more associated prisms in the prism system.

Figure 13:
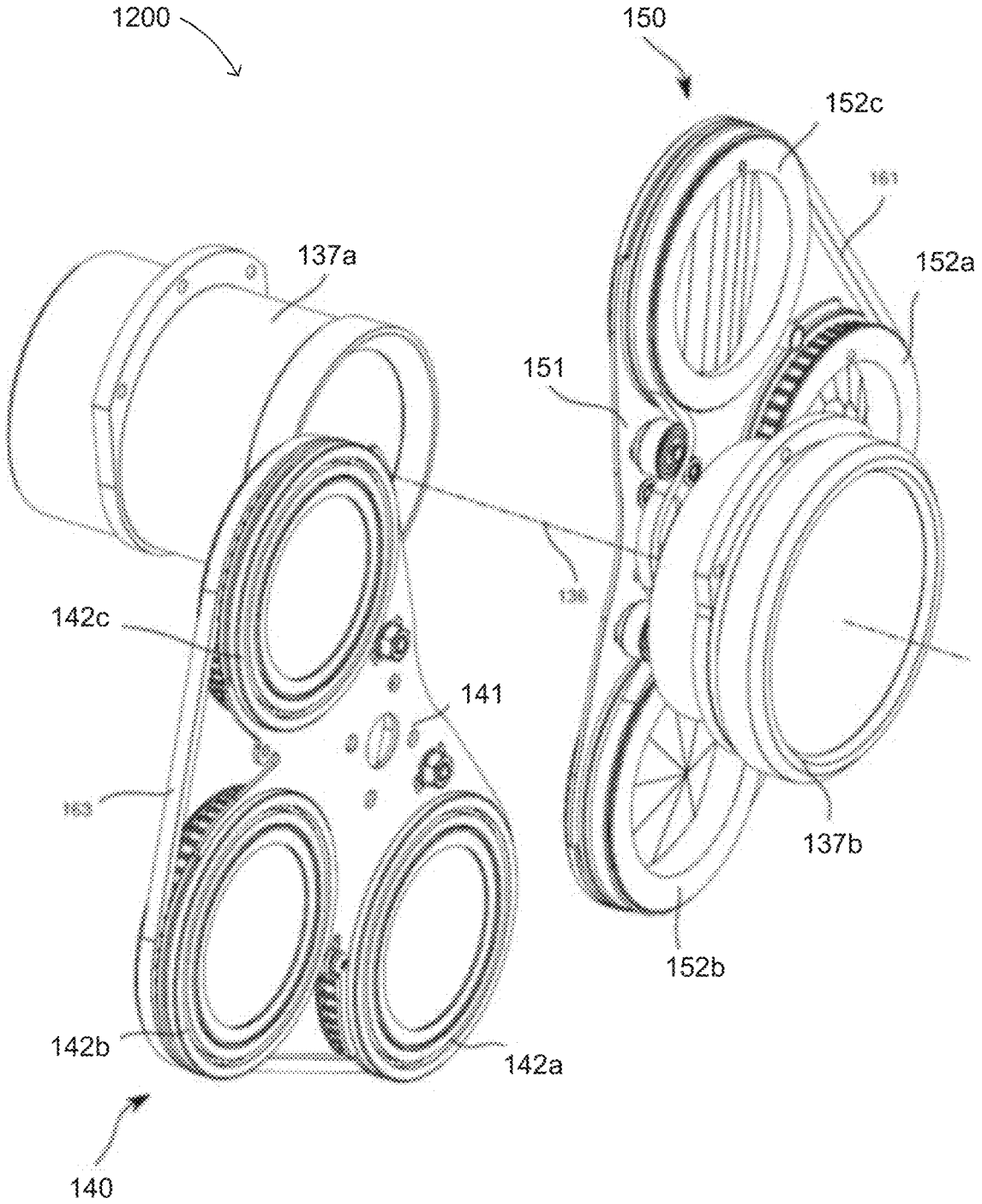
FIG. 13 presents a simplified view of the second coordinated effects system of FIG. 12 in a second configuration.

FIG. 13 presents a simplified view of the second coordinated effects system 1200 of FIG. 12 in a second configuration. In FIG. 13 both first prism support 141 and second prism support 151 have been rotated to remove all prisms from the light beam. A first motor (not shown) is configured to rotate the prisms 152*a*, 152*b*, or 152*c* within the second prism support 151 via a belt 161. A second motor (not shown) is configured to rotate the prisms 142*a*, 142*b*, or 142*c* within the first prism support 141 via a belt 163.

Figure 14:
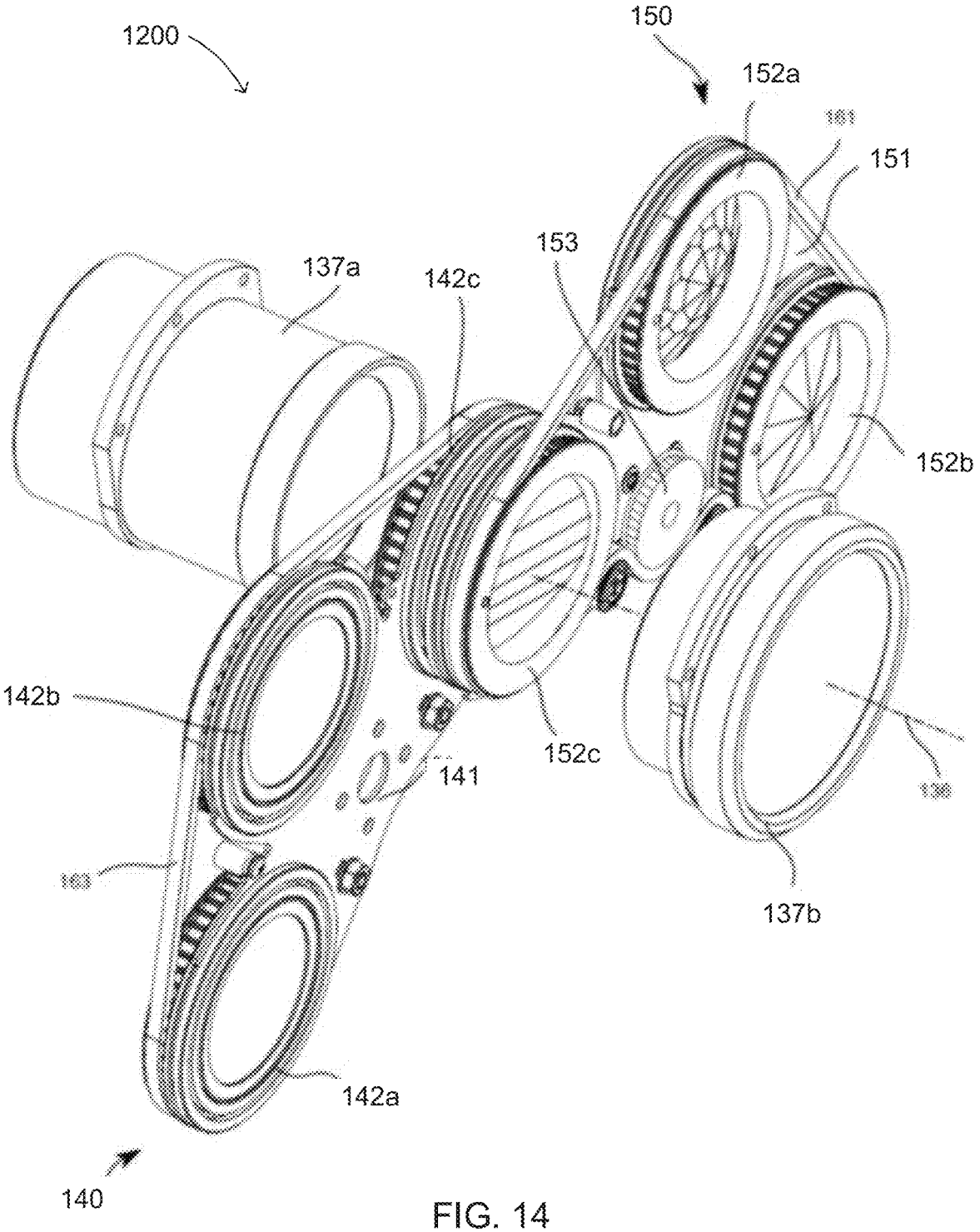
FIG. 14 presents a simplified view of the second coordinated effects system of FIG. 12 in the first configuration.

FIG. 14 presents a simplified view of the second coordinated effects system 1200 of FIG. 12 in the first configuration. In the first configuration, the first prism support 141 and the second prism support 151 have been rotated from their positions in the second configuration shown in FIG. 13 to insert both the prism 142*c* and the prism 152*c* into the light beam. In this first configuration, the prisms will interact to produce results similar to those shown in FIGS. 2, 3, 10, and 11.

FIG. 14 shows a pulley 153 that is coupled to and driven by the first motor described with reference to FIG. 13. The pulley 153 engages the belt 161 and causes the prisms 152*a*, 152*b*, or 152*c* to rotate within the second prism support 151.

Although embodiments with two prism systems have been illustrated and described, in other embodiments any number of prism systems may be utilized to produce complex coordinated effects. Each of the multiple prism systems may be fitted with any number of prisms.

Figure 15:
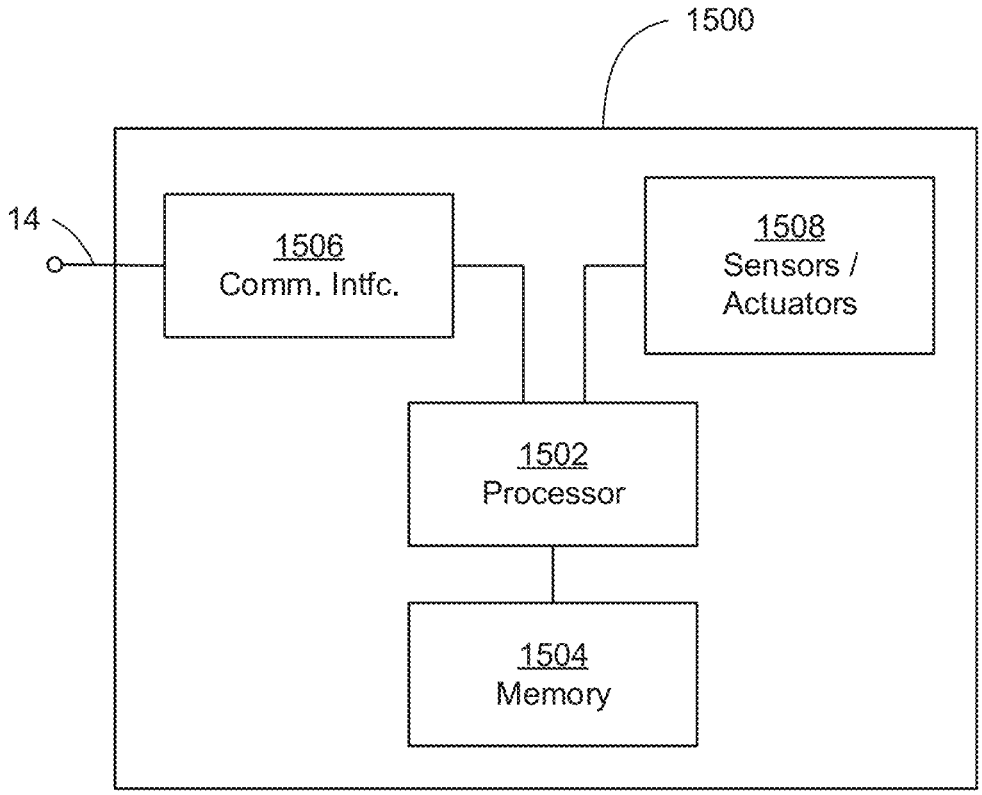
FIG. 15 presents a block diagram of a control system for an automated luminaire according to the disclosure.

FIG. 15 presents a block diagram of a control system (or controller) 1500 for an automated luminaire 100 according to the disclosure. The control system 1500 is suitable for controlling the coordinated effects systems 400 and 1200 described with reference to FIGS. 4-8 and 12-14, respectively. The control system 1500 is also suitable for controlling other control functions of the automated luminaire 100, described with reference to FIG. 9. The control system 1500 includes a processor 1502 electrically coupled to a memory 1504. The processor 1502 is implemented by hardware and software. The processor 1502 may be implemented as one or more Central Processing Unit (CPU) chips, cores (e.g., as a multi-core processor), field-programmable gate arrays (FPGAs), application specific integrated circuits (ASICs), and digital signal processors (DSPs).

The processor 1502 is further electrically coupled to and in communication with a communication interface 1506. The communication interface 1506 is coupled to, and configured to communicate via, the data link 14. The processor 1502 is also coupled via a control interface 1508 to one or more other sensors, motors, actuators, controls and/or other devices. The processor 1502 is configured to receive control signals via the communication interface 1506 and to control the coordinated effects systems 400 and 1200 and other mechanisms of the automated luminaire 100 via the control interface 1508.

The control system 1500 is suitable for implementing processes, coordinated effects control, framing system control, and other functionality as disclosed herein, which may be implemented as instructions stored in the memory 1504 and executed by the processor 1502. The memory 1504 comprises one or more disks, tape drives, and/or solid-state drives and may be used as an overflow data storage device, to store programs when such programs are selected for execution, and to store instructions and data that are read during program execution. The memory 1504 may be volatile and/or non-volatile and may be read-only memory (ROM), random access memory (RAM), ternary content-addressable memory (TCAM), and/or static random-access memory (SRAM).

Conventional framing systems typically use four blades that may be moved independently into and out of the beam, allowing framing a projected image from a lighting fixture to common rectangular shapes, such as picture frames. Often, individual angular control for each blade is provided. Such a framing mechanism enables masking the final output beam to a desired shape by controlling its edges. The framing shutters are typically straight edged so that inserting them into the beam masks an area in a straight line. Motorized systems to both insert and remove and optionally rotate each flag or shutter are often very complex mechanically and add substantial weight and cost to a luminaire.

Figure 16:
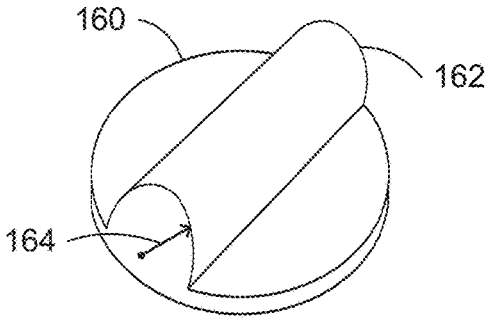
FIG. 16 illustrates a barrel prism for use in a framing system according to the disclosure.

FIG. 16 illustrates a barrel prism 160 for use in a framing system according to the disclosure. Barrel prism 160 comprises a substrate plane with a single semi-cylindrical prism 162 having a radius of curvature 164. Semi-cylindrical prism 162 may be of any diameter, here shown as partially covering the plane area, but in practice may cover the entire area or any proportion of the area. In other embodiments, the cross section of the single semi-cylindrical prism may be modified from a semi-cylinder—e.g., semi-paraboloid, semi-ellipse or other non-cylindrical shapes. In all such embodiments, the prism is a single convex shape with a constant cross section along its length.

Figure 17:
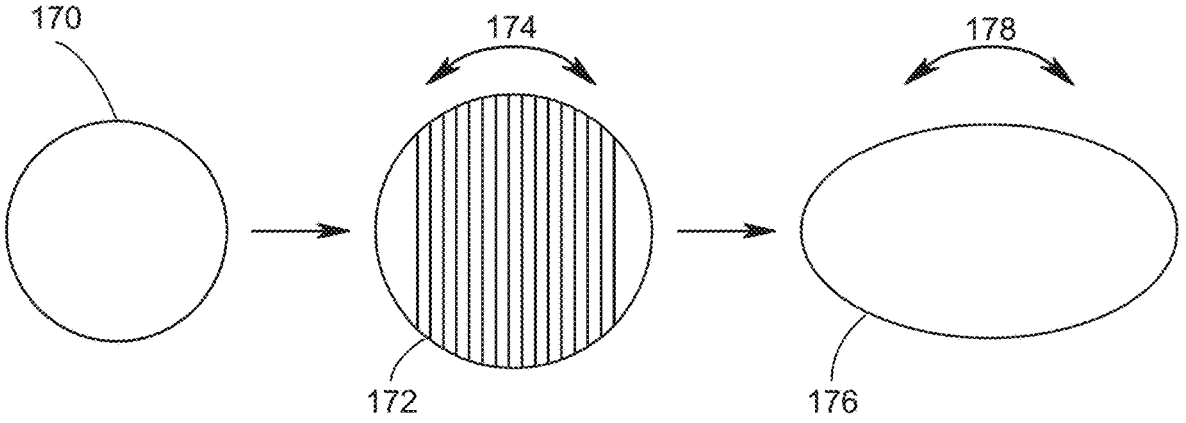
FIG. 17 PRIOR ART
FIG. 17 illustrates the effect of a prior art ribbed or linear prism.

FIG. 17 illustrates the effect of a prior art ribbed or linear prism 172. The ribbed prism 172 comprises multiple parallel ribs or other convex shapes and is commonly used to spread the light in a single direction. As illustrated, a source image 170 produced by beam color, size, shape, and/or pattern optical systems passes through the ribbed prism 172, which may be axially rotated as indicated by arrow 174. The resulting output image 176 is an oval transformation of the source image 170. In particular, if the source image 170 is a circular aperture, then the resultant beam (output image) 176 will be elliptical in shape. This is useful as an effect, but is not useful as a soft edge shutter or framing system, as the sides of the beam are curved. The output image 176 rotates, as shown by arrow 178, as the ribbed prism 172 rotates.

Figure 18:
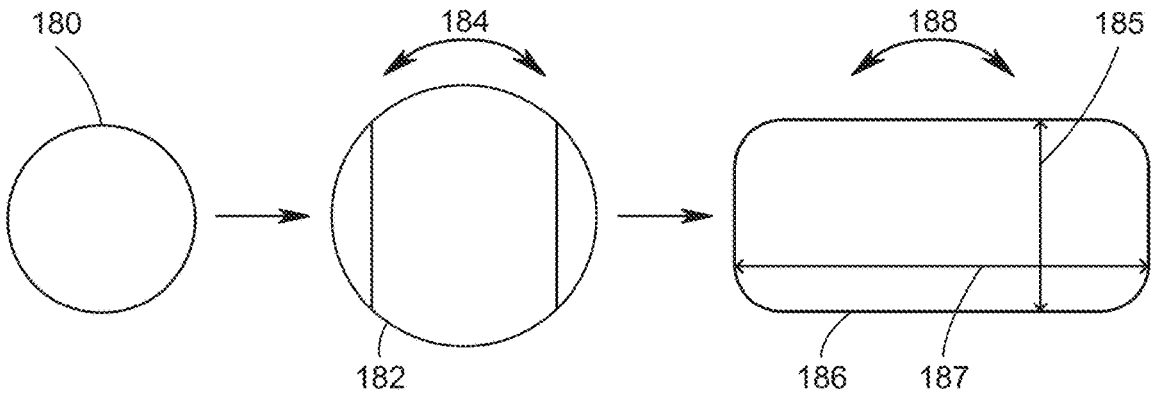
FIG. 18 illustrates the effect of a framing system according to the disclosure, using a barrel prism of the type shown in FIG. 16.

FIG. 18 illustrates the effect of a framing system according to the disclosure, using a barrel prism 182 of the type shown in FIG. 16. The barrel prism 182 is suitable for use in any of prism systems 40 and 50 of the coordinated effects system 400 and prism systems 140 and 150 of the coordinated effects system 1200 described with reference to FIGS. 4-8 and 12-14, respectively. When used in such systems under the control of the control system 1500 in the automated luminaire 100, one or more such barrel prisms 182 provide a framing system according to the disclosure.

The barrel prism 182 comprises a single convex shape as described above. As illustrated, a source image 180 produced by beam color, size, shape, and/or pattern optical systems passes through the barrel prism 182, which may be axially rotated as indicated by arrow 184. A resultant output image 186 is a stretched transformation of the source image 180, with substantially linear edges. In particular if the source image 180 is a circular aperture, then the output image 186 will be approximately rectangular in shape. This provides a new and useful operational mode for the system as a framing system. The output image 186 will rotate, as shown by arrow 188, as the barrel prism 182 rotates.

A first dimension 185 of the output image 186 is determined primarily by a diameter of the source image 180. A second dimension 187 of the output image 186 is determined by the diameter of the source image 180 and additionally by a radius of curvature 164 of the barrel prism 182. As with lenses, a barrel prism 182 having a larger radius of curvature 164 will spread the source image 180 by a lesser amount, resulting in a smaller second dimension 187, while a barrel prism 182 having a smaller radius of curvature 164 will spread the source image 180 by a greater amount, resulting in a larger second dimension 187.

An overall projected size of the output image 186 may be adjusted by varying the zoom setting (focal length) of the optical system of the automated luminaire 100. Changing the size of the aperture producing the source image 180 will affect both the dimensions 185 and 187. Using a barrel prism 182 of greater or lesser radius of curvature 164 will make the second dimension 187 shorter or longer, respectively. One advantage of the single barrel prism over the prior art ribbed or linear prisms is the relatively straight edges of the resultant beam, which allows the use of output image 186 as a framing system, creating a generally rectangular output image 186 that may be rotated, if needed, to match the straight edges of set pieces, doorways, windows, or other targets. The corners of the output image 186 are curved, but that is unlikely to be troubling to a user of a framing system according to the disclosure. A homogenizing or frost filter of the automated luminaire 100 may be used to soften the edges of the output image 186. All of these parameters controlling characteristics of the projected output image 186 may be controlled by a user of the automated luminaire 100 via control signals sent to the control system 1500.

Figure 19:
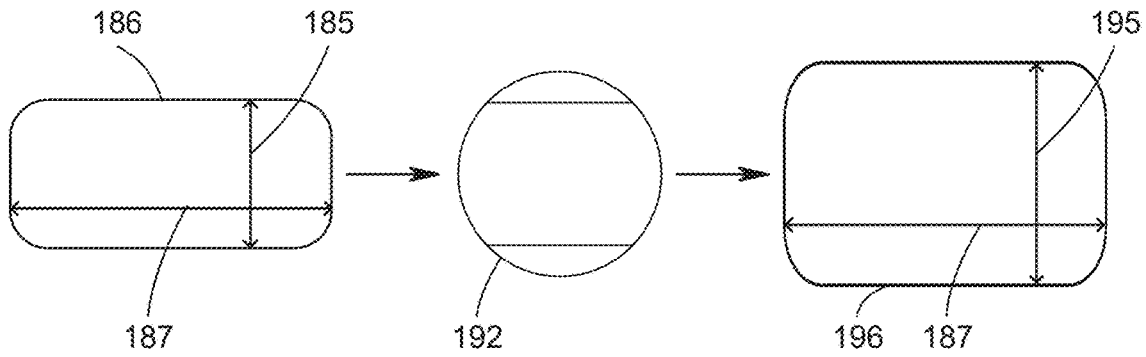
FIG. 19 illustrates the effect of a framing system according to the disclosure, using two barrel prisms of the type shown in FIG. 16.

FIG. 19 illustrates the effect of a framing system according to the disclosure, using two barrel prisms of the type shown in FIG. 16. The luminaire 100 may be fitted with two barrel prisms that may be combined one after the other as described earlier for the coordinated effects systems 400 and 1200 described with reference to FIGS. 4-8 and 12-14, respectively. As described with reference to FIG. 18, the first barrel prism 182 produces the output image 186 from the source image 180. The output image 186 is then a source image for a second barrel prism 192, which produces a resultant output image 196.

Because the barrel prism 192 is rotated to be oriented orthogonally to the barrel prism 182, it stretches the dimension 185 of the source image 186 to the larger dimension 195 of the output image 196. The second dimension 187 of the source image 186 remains substantially unchanged in the output image 196.

An overall projected size of the output image 196 may be adjusted by varying the zoom setting (focal length) of the optical system of the automated luminaire 100. Changing the size of the aperture producing the source image 180 will affect the dimensions of the source image 186 and the dimensions of the output image 196. Using a barrel prism 192 of greater or lesser radius of curvature 164 will make the dimension 195 shorter or longer, respectively.

Thus, by the selection of a size of the source image 180, the radii of curvature of the barrel prisms 182 and 192, the setting of the zoom optical system of the automated luminaire, and the use of a frost filter, the user of the automated luminaire 100 is enabled to produce an projected rectangular image having a wide range of size, aspect ratio, and edge softness. Furthermore, by rotating both barrel prisms while retaining their rotational orientation relative to each other, the projected rectangular image may be rotated to align with edges of set pieces, risers, or other targets in a performance space.

Conventional framing systems are complex mechanisms requiring numerous motors/actuators that add significant weight and/or cost to an automated luminaire. Such framing systems typically use as framing shutters thin metallic plates that warp or are otherwise damaged when used in a luminaire having a high beam intensity and/or a pronounced hot spot. A framing system according to the disclosure is less complex, uses fewer actuators, is lighter, less expensive, and is much more resistant to beam intensity and hot spot than conventional framing systems.

One or both of the barrel prisms of a framing system according to the disclosure may also be used as a coordinated effects system as described for the coordinated effects systems 400 and 1200 described with reference to FIGS. 4-8 and 12-14, respectively. In a first configuration, a barrel prism may be positioned in a light beam that has passed through a prism of another type. The barrel prism will spread the effect of the other prism in a similar way as described above for spreading a circular source image. In a second configuration, two barrel prisms may be positioned in the light beam and rotated relative to each other to produce an output image that changes shape from a first rectangle to a first rhomboid to a second rectangle to a second rhomboid, etc. In such a second configuration, the barrel prisms may be rotated in the same direction at differing speeds, one barrel prism may be rotated while the other barrel prism remains static (i.e., at a rotational speed of zero), or the barrel prisms may be rotated in opposite directions at the same or differing speeds While the disclosure has been described with respect to a limited number of embodiments, those skilled in the art, having benefit of this disclosure, will appreciate that other embodiments may be devised which do not depart from the scope of the disclosure herein. While the disclosure has been described in detail, it should be understood that various changes, substitutions and alterations can be made hereto without departing from the spirit and scope of the disclosure.

What is claimed is:

1. A framing system, comprising:

a first prism system comprising a first barrel prism, the first barrel prism comprising a substrate plane with a single curved convex prism having a constant cross section along the entirety of its length, its length extending across a light beam passing through the first prism system, the first prism system configured to position the first prism system in first and second positions, in the first position the first barrel prism being positioned in the light beam passing through the first prism system and in the second position the first barrel prism being removed from the light beam passing through the first prism system, the first prism system further configured to rotate the first barrel prism; and a second prism system comprising a second barrel prism, the second barrel prism comprising a substrate plane with a single curved convex prism having a constant cross section along the entirety of its length, its length extending across the light beam passing through the first prism system, the second prism system configured to position the second prism system in third and fourth positions, in the third position the second barrel prism being positioned in the light beam passing through the first prism system and in the fourth position the second barrel prism being removed from the light beam passing through the first prism system, the second prism system further configured to rotate the second barrel prism.

2. The framing system of claim 1, wherein:

the first prism system is configured to detect an orientation of the first barrel prism in the first position; and the second prism system is configured to detect an orientation of the second barrel prism in the third position.

3. The framing system of claim 1, wherein:

the first prism system comprises a first plurality of barrel prisms, the curved convex prism of each of the first plurality of barrel prisms comprising a semi-cylindrical prism having a radius of curvature different from the curved convex prisms of other barrel prisms of the first plurality of barrel prisms, wherein in the first position, a selected one of the first plurality of barrel prisms is positioned in the light beam passing through the first prism system, and in the second position all of the first plurality of barrel prisms are removed from the light beam passing through the first prism system; and the second prism system comprises a second plurality of barrel prisms, the curved convex prism of each of the second plurality of barrel prisms comprising a semi-cylindrical prism having a radius of curvature different from the curved convex prisms of other barrel prisms of the second plurality of barrel prisms, wherein in the third position, a selected one of the second plurality of barrel prisms is positioned in the light beam passing through the first prism system and in the fourth position all of the second plurality of barrel prisms are removed from the light beam passing through the first prism system.

4. The framing system of claim 3, wherein:

the first prism system comprises a sensor configured to detect an orientation of the selected one of the first plurality of barrel prisms positioned in the light beam passing through the first prism system; and the second prism system comprises a sensor configured to detect an orientation of the selected one of the second plurality of barrel prisms positioned in the light beam passing through the first prism system.

5. The framing system of claim 3, wherein:

the first prism system comprises a first stepper motor configured to move the first prism system from the first position to the second position; and the second prism system comprises a second stepper motor configured to move the second prism system from the third position to the fourth position.

6. The framing system of claim 1, wherein:

the first prism system comprises a first stepper motor configured to rotate the first barrel prism; and the second prism system comprises a second stepper motor configured to rotate the second barrel prism.

7. The framing system of claim 1, wherein the first prism system comprises:

an arm on which is rotatably mounted the associated barrel prism; and an actuator coupled to the arm, the actuator configured to rotate the arm from the first position to the second position.

8. An automated luminaire, comprising:

a light source configured to emit a light beam;

an optical device optically coupled to the light source and configured to produce a source image in the light beam;

a first prism system comprising a first barrel prism, the first barrel prism comprising a substrate plane with a single curved convex prism having a constant cross section along the entirety of its length, its length extending across a light beam passing through the first prism system, the first prism system optically coupled to the optical device and configured to position the first prism system in first and second positions, in the first position the first barrel prism being positioned in the light beam passing through the first prism system and in the second position the first barrel prism being removed from the light beam passing through the first prism system, the first prism system further configured to rotate the first barrel prism to produce a modified image from the source image;

a second prism system comprising a second barrel prism, the second barrel prism comprising a substrate plane with a single curved convex prism having a constant cross section along the entirety of its length, its length extending across the light beam passing through the first prism system, the second prism system optically coupled to the first prism system and configured to position the second prism system in third and fourth positions, in the third position the second barrel prism being positioned in the light beam passing through the first prism system and in the fourth position the second barrel prism being removed from the light beam passing through the first prism system, the second prism system further configured to rotate the second barrel prism to produce an output image from the modified image; and a control system configured to control the optical device, the first prism system, and the second prism system.

9. The automated luminaire of claim 8, wherein:

the optical device is configured to produce a circular light beam; and the automated luminaire further comprises an optical system optically coupled to the second prism system and configured to project a light beam passing through the second prism system onto a target in a performance space.

10. The automated luminaire of claim 8, wherein the control system is configured to:

detect a first orientation of the first barrel prism;

detect a second orientation of the second barrel prism; and control rotation of the first barrel prism and rotation of the second barrel prism based on the detected first and second orientations.

11. The automated luminaire of claim 10, wherein the control system is configured to rotate the first barrel prism to a first desired orientation and to rotate the second barrel prism to a second desired orientation.

12. The automated luminaire of claim 10, wherein the control system is configured to rotate the first barrel prism and the second barrel prism while maintaining a desired rotational alignment between the first barrel prism and the second barrel prism.

13. The automated luminaire of claim 8, wherein the control system is configured to rotate the first barrel prism and the second barrel prism at differing rotational speeds.

14. The automated luminaire of claim 8, wherein the control system is configured to rotate the first barrel prism at a first speed and the second barrel prism at a second speed.

15. The automated luminaire of claim 8, wherein the control system comprises a communication interface and the control system is configured to control the first prism system and the second prism system in response to control signals received via the communication interface.

16. A method for shaping a light beam projected by an automated luminaire, comprising:

forming a circular light beam;

modifying the circular light beam with a selected refractive element to form a rounded rectangular beam having a desired aspect ratio;

rotating the selected refractive element to obtain a desired orientation of the rounded rectangular beam; and projecting the rotated rounded rectangular beam from an automated luminaire onto a target in a performance space.

17. The method of claim 16, wherein the selected refractive element is a first selected refractive element and the rounded rectangular beam is a first rounded rectangular beam, the method further comprising:

modifying the first rounded rectangular beam with a second selected refractive element to form a second rounded rectangular beam having a desired aspect ratio, the first and second selected refractive elements having an orthogonal orientation relative to each other;

rotating the first and second selected refractive elements to obtain a desired orientation of the second rounded rectangular beam while maintaining the orthogonal orientation between the first and second selected refractive elements; and projecting the second rotated rounded rectangular beam from the automated luminaire onto the target in the performance space.

18. The method of claim 16, further comprising changing a size of the projected rotated rounded rectangular beam by changing a size of the circular light beam or by adjusting a configuration of a zoom optical system of the automated luminaire.

19. The framing system of claim 1, wherein the curved convex prism of the first barrel prism comprises a semi-cylindrical prism and the curved convex prism of the second barrel prism comprises a semi-cylindrical prism.

20. The automated luminaire of claim 8, wherein the curved convex prism of the first barrel prism comprises a semi-cylindrical prism and the curved convex prism of the second barrel prism comprises a semi-cylindrical prism.

* * * * *